US008523008B2

(12) United States Patent
Kim et al.

(10) Patent No.: US 8,523,008 B2
(45) Date of Patent: Sep. 3, 2013

(54) INSULATION SLEEVE FOR CUP

(75) Inventors: Chang Sub Kim, Gyeonggi-do (KR); Jun Soo Kim, Gangnam-gu Seoul (KR)

(73) Assignee: To Go Sol Co., Ltd., Seoul (KR)

( * ) Notice: Subject to any disclaimer, the term of this patent is extended or adjusted under 35 U.S.C. 154(b) by 384 days.

(21) Appl. No.: 12/702,728

(22) Filed: Feb. 9, 2010

(65) Prior Publication Data

US 2010/0200603 A1 Aug. 12, 2010

(30) Foreign Application Priority Data

Feb. 10, 2009 (KR) ..... 20-2009-0001420 U
Feb. 17, 2009 (KR) ..... 20-2009-0012943 U
Feb. 25, 2009 (KR) ..... 20-2009-0002108 U

(51) Int. Cl.
*B65D 3/28* (2006.01)

(52) U.S. Cl.
USPC ..... 220/738; 220/739

(58) Field of Classification Search
USPC ..... 220/737, 738, 739, 771; 229/402, 229/403
See application file for complete search history.

(56) References Cited

U.S. PATENT DOCUMENTS 2,060,781 A * 11/1936 Annen ..... 229/402
2,454,906 A * 11/1948 Amberg ..... 229/402
2,979,301 A * 4/1961 Reveal ..... 248/214
6,273,333 B1 * 8/2001 Ward ..... 229/402
6,315,192 B1 * 11/2001 Marlow ..... 229/401
6,343,735 B1 * 2/2002 Cai ..... 229/117.23
D485,133 S * 1/2004 Breeze-Stringfellow ..... D7/622
2006/0000882 A1 * 1/2006 Darzinskas ..... 229/403
2008/0083767 A1 * 4/2008 O'Neal ..... 220/739
2008/0142529 A1 * 6/2008 LaGuardia et al. ..... 220/592.2
2008/0283538 A1 * 11/2008 Rowen ..... 220/739
2008/0285621 A1 * 11/2008 Rowen ..... 374/150
2009/0114661 A1 * 5/2009 Lim ..... 220/737
2009/0272753 A1 * 11/2009 Rebelak et al. ..... 220/737
2010/0224637 A1 * 9/2010 Ikeda et al. ..... 220/592.2

* cited by examiner

*Primary Examiner* — David Fidei
(74) *Attorney, Agent, or Firm* — Bill C. Panagos; Linda D. Kennedy; Butzel Long

(57) ABSTRACT

An insulation sleeve including a protrusion formed on a sidewall of the cup which is caught by a finger of a user's hand is provided, in which, in a case where the cup is filled with a hot content, the user can easily and safely grip the cup, without slippage, at movement with the cup. The insulation sleeve includes a sleeve body having a hollow portion which is formed when a force is applied both corners of the folded sleeve body so as to accommodate and support the cup therein; and a pair of protrusions formed by a ⊥-shaped, ⊥-shaped, ⊂-shaped or L-shaped cut line provided on the sleeve body, and protruding from the sleeve body in an outward direction when the hollow portion is provided, so that the protrusions are caught by a an upper portion of a finger of a hand gripping the sleeve body.

7 Claims, 27 Drawing Sheets

INSULATION SLEEVE FOR CUP

CROSS-REFERENCE TO RELATED APPLICATION

This application is based on and claims priority from Korean Patent Application No. KR20-2009-0001420, KR10-2009-0012943 and KR20-2009-0002108, each filed on 10 Feb. 2009, 17 Feb. 2009 and 25 Feb. 2009 in the Korean Intellectual Property Office and International Application No. PCT/KR2009/004038, filed on 13 Aug. 2009 in the World Intellectual Property Organization, the disclosure of which is incorporated herein in its entirety by reference.

BACKGROUND OF THE INVENTION

1. Field of the Invention

The present invention relates to an insulation sleeve holding a cup, and more particularly, to an insulation sleeve including a protrusion formed on a sidewall of the cup which is caught by a finger of a user's hand, so that, in a case where the cup is filled with a hot content, the user can easily and safely grip the cup, without slippage, at movement with the cup.

2. Description of the Prior Art

A disposable paper cup is usually used at, for example, a take-out coffee shop as a container filling a drink. The paper cup is generally made of thin paper, because of its disposable property.

If the paper cup is filled with a hot drink such as coffee, the temperature of the drink is quickly transmitted to the surface of the paper cup, the paper cup itself is very hot, and thus it is inconvenient for the user to grip the hot paper cup.

In addition, if the user holds the cup with his or her finger by a narrow margin so as to avoid the hot, the user may drop the paper cup, and the user may suffer scald due to spilled coffee.

In order to solve the above problem, a holder (sleeve) 11 holding a sidewall of the cup 10 is used, as shown in FIG. 1. The sleeve 11 forms an insulating layer on the sidewall of the cup 10 to eliminate somewhat the hot of the cup.

The sleeve 11 is usually made of paper, and the sleeve 11 has a smooth surface so as to form a printing surface for advertisement.

The sleeve 11 has a little insulation function, but the sleeve 11 is easily slipped on the user's hand because of the smooth surface thereof.

In addition, the sleeve 11 made of the paper has a hygroscopic property, but the outer surface is dried due to the high temperature of the content filled in the cup 10. Therefore, the outer surface is further smooth, and thus the sleeve may be more easily slipped on the hand.

As a result, the user strongly holds the sleeve so that the cup is not slipped on the hand. Thus, even though the sleeve is used, the high temperature of the cup is transmitted to the sleeve intact, the difficult in the gripping exists still.

There is another problem in that the sleeve is easily slipped down. For example, when the cup filled with hot coffee or cold drink is laid on a table for the purpose of conversation, the sleeve holding the cup on the table is frequently slipped down. Consequently, in a case where the user wants to drink the coffee or drink, the user has to raise the sleeve slipped down.

SUMMARY OF THE INVENTION

Accordingly, the present invention has been made to solve the above-mentioned problems occurring in the prior art while advantages achieved by the prior art are maintained intact.

One object of the present invention is to provide an insulation sleeve including an anti-slip means naturally protruding from the sleeve in an outward direction when a cup is accommodated in the insulation sleeve, so that the anti-slip means is caught by a finger of a hand gripping the cup.

Another object of the present invention is to provide an insulation sleeve which can allow a user to fully grip the sleeve without slippage, when the user moves with the cup filled with contents.

Still another object of the present invention is to provide an insulation sleeve which is not easily slipped down after the cup is worn with the insulation sleeve.

Still another object of the present invention is to provide an insulation sleeve capable of preventing an anti-slip means when the insulation sleeve is manufactured or is shipped.

Still another object of the present invention is to provide an insulation sleeve capable of representing characters or symbols at a predetermined temperature when a cup is filled with hot coffee.

In order to accomplish these objects, there is provided an insulation sleeve for a cup, according to an embodiment of the present invention, which includes a sleeve body having a hollow portion which is formed when a force is applied both corners of the folded sleeve body so as to accommodate and support the cup therein; and a pair of protrusions formed by a ⊥-shaped cut line provided on the sleeve body, and protruding from the sleeve body in an outward direction when the hollow portion is provided, so that the protrusions are caught by a an upper portion of a finger of a hand gripping the sleeve body.

According to another aspect of the present invention, there is provided an insulation sleeve for a cup, which includes a sleeve body having a hollow portion which is formed when a force is applied both corners of the folded sleeve body so as to accommodate and support the cup therein; and a pair of protrusions formed by a ⊥-shaped cut line provided on the sleeve body, and protruding from the sleeve body in an outward direction when the hollow portion is provided, so that the protrusions are caught by a an upper portion of a finger of a hand gripping the sleeve body.

According to still another aspect of the present invention, there is provided an insulation sleeve for a cup, which includes a sleeve body having a hollow portion which is formed when a force is applied both corners of the folded sleeve body so as to accommodate and support the cup therein; and a pair of protrusions formed by a ⊂-shaped cut line provided on the sleeve body, and protruding from the sleeve body in an outward direction when the hollow portion is provided, so that the protrusions are caught by a an upper portion of a finger of a hand gripping the sleeve body.

According to still another aspect of the present invention, there is provided an insulation sleeve for a cup, which includes a sleeve body having a hollow portion which is formed when a force is applied both corners of the folded sleeve body so as to accommodate and support the cup therein; and a pair of protrusions formed by a L-shaped cut line provided on the sleeve body, and protruding from the sleeve body in an outward direction when the hollow portion is provided, so that the protrusions are caught by a an upper portion of a finger of a hand gripping the sleeve body.

The insulation sleeve further includes a ⊥-shaped or ⊂-shaped cut line on a portion of the sleeve body which is spaced apart from the cut line in a downward direction by at least a width of the finger, in which a support portion protrudes from the sleeve body in an outward direction when the hollow portion is provided.

An outer wall of the insulation sleeve for the cup may be printed with a character or symbol which can be represented according to a variation of temperature.

The cut line may be formed by cutting at least one joint portion which is formed on the cut line.

An end of the cut line is provided with an extension cut line.

With the above description, according to the insulation sleeve for the cup of the present invention, since the sleeve body is provided with the protrusions protruding from the sidewall thereof, the protrusions are caught by the fingers of the hand gripping the sleeve body to prevent the slippage.

Further, since the protrusions naturally protrude from the sleeve body in the outward direction in the process of opening the folded sleeve body, it is not necessary for separate manipulation to bring the protrusion to protrude.

Since the protrusions formed integrally with the sleeve body can be resiliently bent in view of its material property, the user can grip the sleeve body with the protrusions.

Further, since the cut line is formed by a simple cutting manner, a manufacturing cost or manufacturing process is not complicated, as compared with a conventional sleeve.

Since the protrusions do not protrude from the sleeve body in the outward direction in a stat in which the sleeve body is folded, the packaging convenience or packaging volume is not different from the conventional sleeve, even though the cut line is formed.

In addition, the protrusions protruding from the sidewall of the sleeve body occupies an area which is required for the finger gripping the upper portion of the sleeve body, so that it does not obstruct the formation of the printed surface for advertisement on the sidewall of the sleeve body.

Further, since the user can smoothly grip the cup by the protrusions, the gripping is easy and the movement of the held cup is safe. Also, the heat conduction to the hand is minimized.

In the case in which the uncut joint portion is formed on the cut line, it is possible to prevent the protrusions from being moved at the packaging, carrying, or keeping and thus prevent the deformation or damage of the protrusions.

Further, in the case in which the support portion is provided, in addition to the protrusion, the fingers gripping the sleeve body are supported at upper and lower sides, it is possible to reliably hold the cup.

In addition, since the characters or symbols printed on the outer wall of the cup sleeve are represented at a predetermined temperature, it is possible to allow the consumer to predict the temperature of the coffee when he or she grips the sleeve holding the cup, thereby preventing the consumer from scalding.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Hereinafter, preferred embodiments of the present invention will be described with reference to the accompanying drawings. The matters defined in the description, such as the detailed construction and elements, are nothing but specific details provided to assist those of ordinary skill in the art in a comprehensive understanding of the invention, and thus the present invention is not limited thereto.

Figure 1:
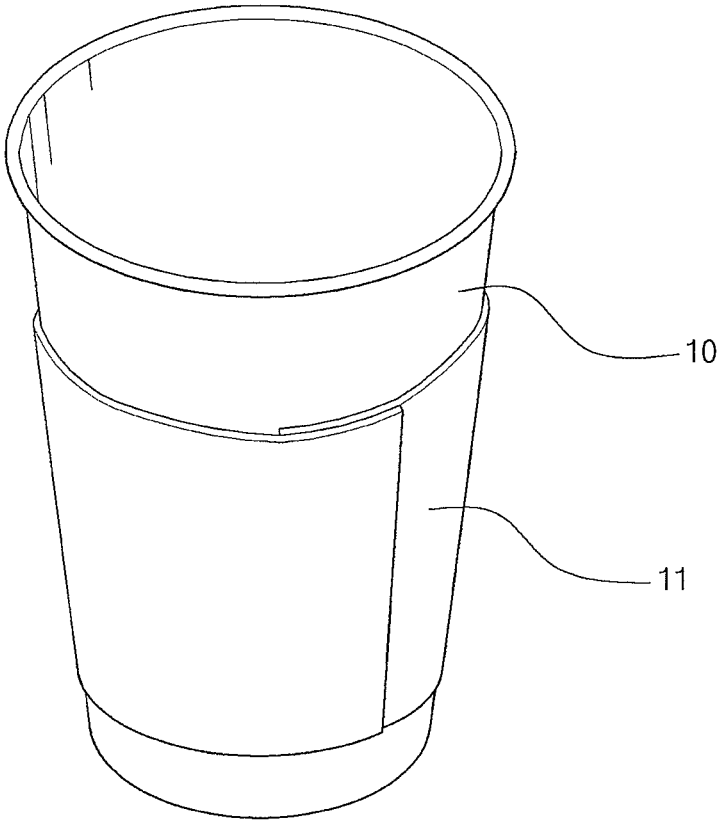
FIG. 1 PRIOR ART
FIG. 1 is a perspective view of a cup sleeve of a related art.
Figure 2:
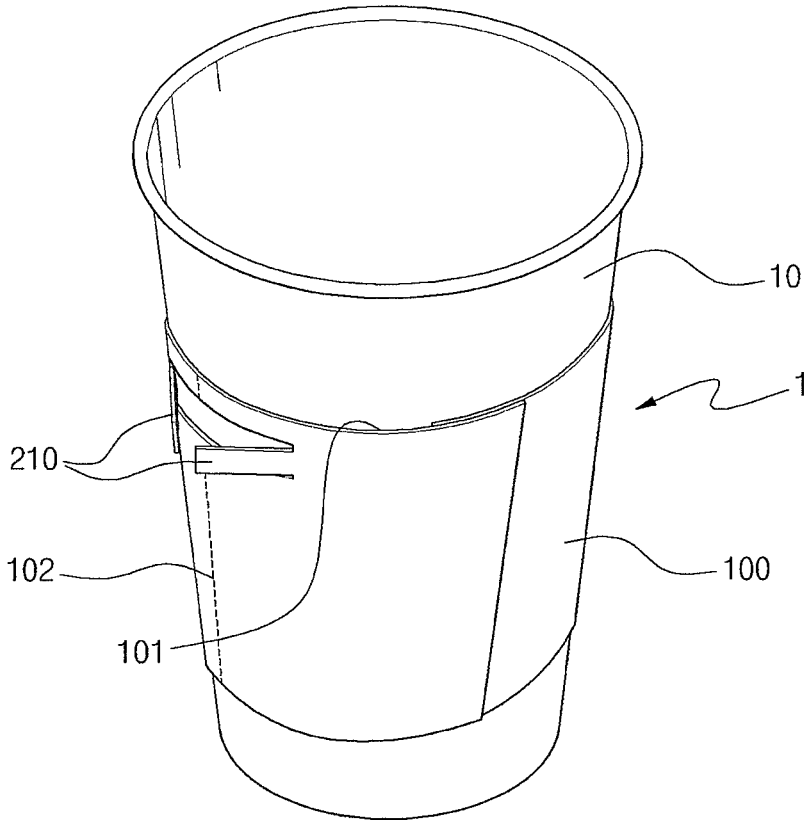
FIG. 2 is a perspective view illustrating a state in which a cup is accommodated in a sleeve according to a first embodiment of the present invention.
Figure 3:
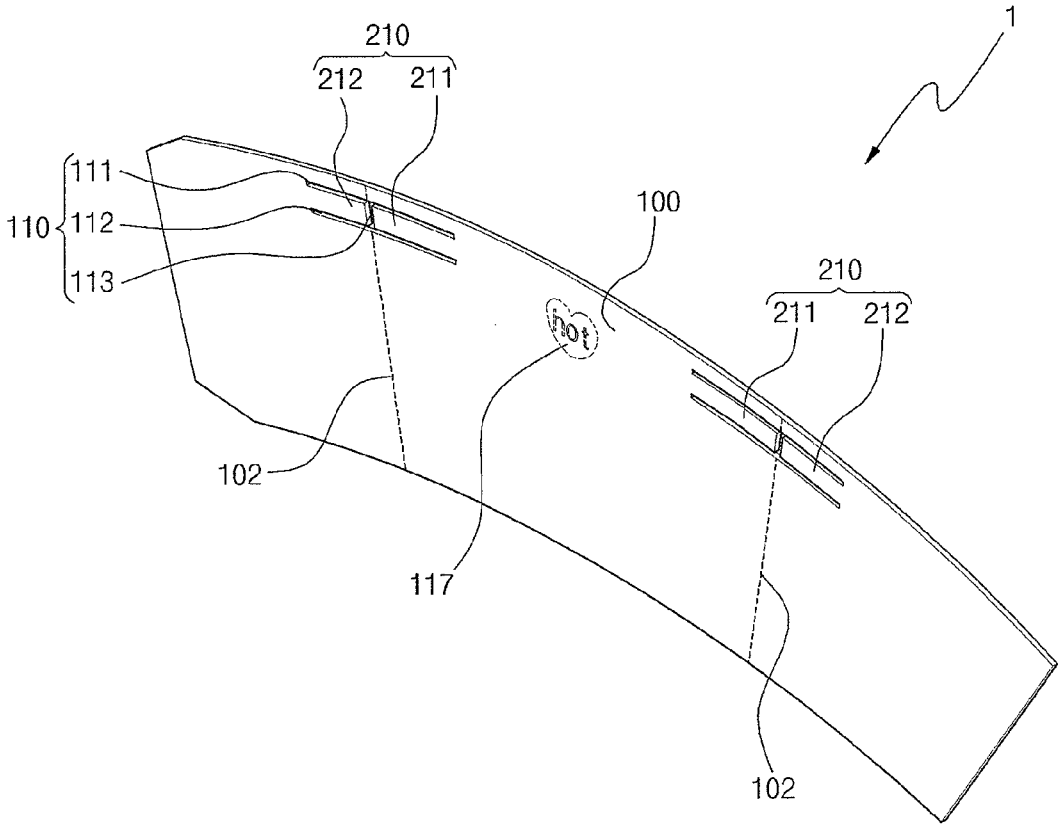
FIG. 3 is a deployment view of the sleeve in FIG. 2.
Figure 4:
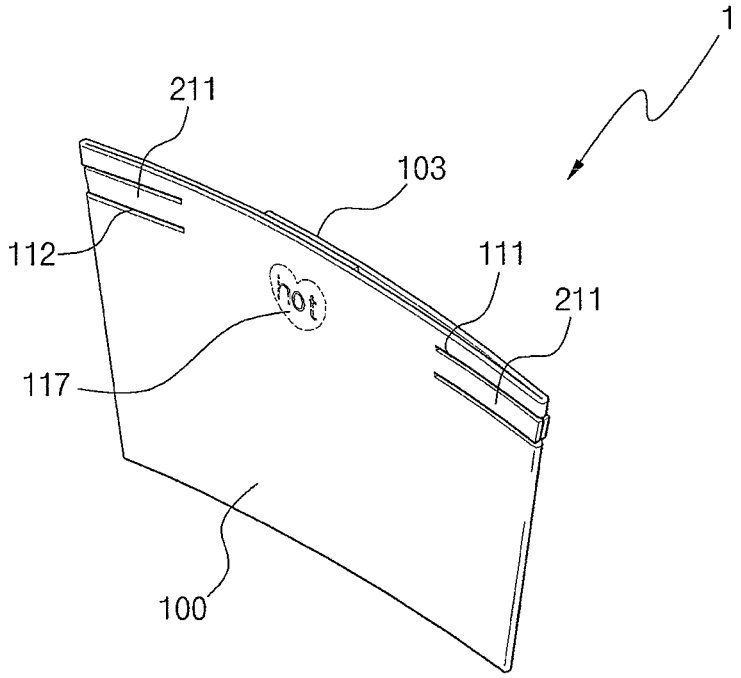
FIG. 4 is a perspective view illustrating a state in which a sleeve body of the sleeve in FIG. 2 is folded.
Figure 5:
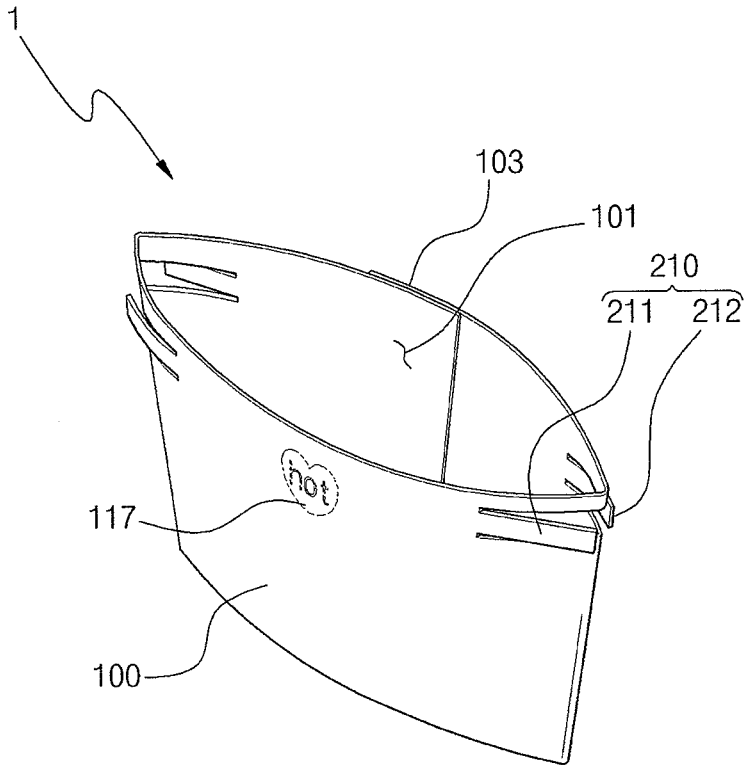
FIG. 5 is a perspective view illustrating a state in which protrusions protrude as the sleeve body in FIG. 4 is opened wide.
Figure 6:
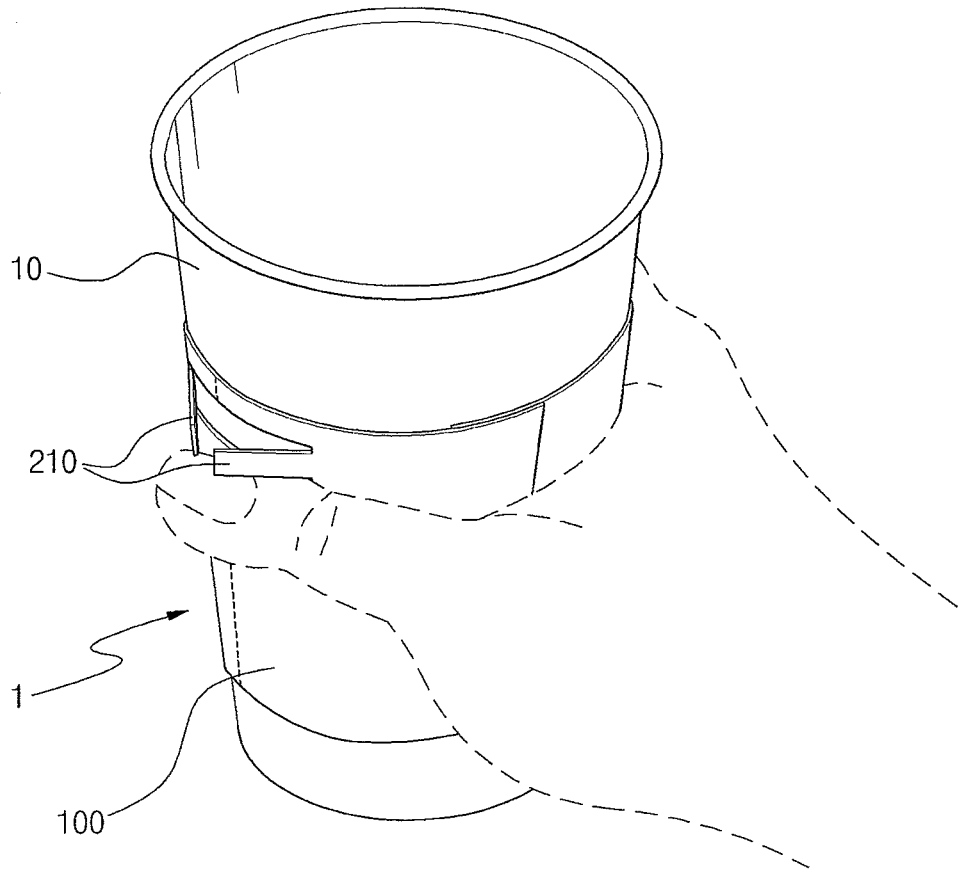
FIG. 6 is a view illustrating a use state of the sleeve shown in FIG. 2.

FIGS. 2 to 6 illustrate an insulation sleeve according to a first embodiment of the present invention. FIG. 2 is a perspective view illustrating a state in which a cup is accommodated in the sleeve according to the first embodiment of the present invention. FIG. 3 is a deployment view of the sleeve in FIG. 2. FIG. 4 is a perspective view illustrating a state in which the sleeve body of the sleeve in FIG. 2 is folded. FIG. 5 is a perspective view illustrating a state in which protrusions protrude from the sleeve body as the sleeve body in FIG. 4 is opened wide. FIG. 6 is a view illustrating a use state of the sleeve shown in FIG. 2.

A sleeve 1 according to the first embodiment of the present invention includes a sleeve body 100 and a pair of protrusions 210, as shown in FIGS. 2 to 6.

The holder (sleeve) body 100 is made of any material such as plastic or paper, and is preferably made of paper, in particular, a corrugated cardboard, in view of a manufacturing cost.

The corrugated cardboard is a paper-based material consisting of a fluted corrugated sheet and one or two flat linerboards adhered to the fluted corrugated sheet by an adhesive.

If the sleeve body 100 is formed of a corrugated cardboard, there is an advantage of enhancing a heat insulating function due to an air layer formed between valleys of the corrugated sheet.

As shown in FIGS. 3 to 5, the sleeve body 100 is formed in a flat shape in such a manner that both ends are overlapped with each other.

A hollow portion 101 is formed in the sleeve body 100 so as to hold the cup 10 therein, when a force is applied to both corners in a state in which the sleeve body 100 is folded.

So as to hold the cup 10 in the hollow portion 101, the hollow portion 101 has a diameter which is gradually decreased from the upper portion toward the lower portion.

In this embodiment, the sidewall of the sleeve body 100 is provided with a I-shaped (corresponding to an H shape which is rotated at right angle) 110, as shown in FIG. 3.

As the cut line 110 is formed, a pair of opposite protrusions 210 are formed on an inside of the cut line 110.

The pair of protrusions 210 protrude in an outward direction from the sleeve body 100 in a process of accommodating the cup 10.

Fingers of the hand gripping the sleeve body 100 are caught by the pair of protrusions 210, thereby preventing the sleeve body 100 from sliding in the hand.

Taking the gripping of the sleeve body 100 with a user's hand into consideration, it is preferable to form the cut line 110 on the upper portion of the sleeve body 100. In this embodiment, the cut line 110 is formed at a position spaced apart from the uppermost end of the sleeve body 100 at a predetermined distance.

The pair of protrusions 210 protrudes in an outward direction from the sleeve body 100 in a state in which the hollow portion 101 is formed in the sleeve body 100. More specifically, the protrusion 210 is gradually away from the sidewall of the sleeve body 100 toward a free end thereof.

As shown in FIGS. 3 and 4, the outer wall of the sleeve body 100 may be printed with characters or symbols 117 (e.g., heart-shaped symbol or hot) by using thermochromic ink. This allows a consumer preferring a hot coffee to figure out proper temperature of the hot coffee in a case where any coffee heated by proper temperature has good taste and redolence, and allows the consumer to predict the temperature of the coffee when he or she grips the sleeve holding the cup, thereby preventing the consumer from scalding.

Further, the characters or symbols specially printed (by using the thermochromic ink) may be represented above or under predetermined temperature (when cold drink is filled therein).

The printed characters or symbols 117 are provided so as not to overlap with other printings (e.g., company's logo) of the cup sleeve, and the company's logo may be specially printed.

Although not shown, characters or symbols may be printed on a predetermined position of the cup (a portion which is not covered by the cup sleeve), so that the consumer recognizes the temperature of the coffee or drink to enjoy the taste and redolence.

The thermochromic ink is well known in the art, and the detailed description is omitted herein. However, in this embodiment, color representing temperature of the cup is set to about 90 degrees, and a color temperature variation of the cup sleeve is set to about 50 to 70 degrees. Of course, the temperature set can be adjusted depending upon a component ratio of the ink, and the color represented by the cold drink and the temperature set of the changed color can be selected.

The formation of the cut line 110 will be described in detail.

As shown in FIG. 3, upper and lower cut lines 111 and 113 are formed in a horizontal direction on the sleeve body 100 at a predetermined interval in a vertical direction. In this instance, the cut lines 111 and 112 are not necessarily parallel with each other, and the direction of the cut lines 111 and 112 is not necessarily formed in the horizontal direction. The cut line 113 is formed in a vertical direction on the sleeve body from the upper end to the lower end between the cut lines 111 and 112.

The cut line 110 formed by the cut lines 111, 112 and 113 forms the I shape (corresponding to an H shape which is rotated at right angle), and the portion which is divided into two parts by the cut line 113 formed in the vertical direction forms the pair of protrusions 210.

It is preferable that the cut lines 111 and 112 formed in the horizontal direction have a predetermined width so as not to cause friction between the protrusions 210 when the protrusions 210 protrude. The cut line 113 formed in the vertical direction may have a predetermined width.

That is, the cut line 110 is formed to have the minimum width so as not to cause the friction in a process of protruding the protrusions 210, and this feature is similar to cut lines 120, 130 and 140 which will be described below in the following embodiments.

In order to further protrude the protrusions 210, the end portion of the cut lines 111 and 112 formed in the horizontal direction may be provided with extension cut line 900. More specifically, as shown in the figure, the extended cut line 900 extended in the length of 0.5 mm to 3 mm may be formed on the both ends of the upper cut line 111, and the extension cut line 900 having the same length may be formed on both ends of the lower cut line 112. In this instance, the extension cut line 900 may be inclined at both ends of the cut lines 111 and 112 at an angle of about 20 to 50 degrees. The number, length and direction of the extension cut line 900 are not limited to the shown and described embodiment, and those may be altered if necessary. Further, the extension cut line 900 may be formed in cut lines 120, 130, 140, 160 and 170 of the following embodiments, as the cut line 110 of this embodiment.

According to the cut line 110 formed as described above, as shown in FIG. 5, when the sleeve body 100 is opened wide so as to form the hollow portion 101, the cut line 110 is bent. In this instance, the pair of protrusions 210 are not bent, but protrude in the outward direction from the sleeve body 100.

One cut line 110 may be formed on the sidewall of the sleeve body 100. Alternatively, another cut line 110 may be formed at a position opposite to the sidewall of the sleeve body 100. In this instance, the protrusions 210 are formed on both sides of the sleeve body 100, so that the protrusions 210 formed at both sides of the sleeve body 100 are caught by the fingers of the hand gripping the sleeve body 100. Further, it is reasonable that the opposite protrusion 210 may be installed at different position in view of a difference in length of fingers of westerners and Asians or a difference in length of fingers of individual.

The feature of the protrusions 210 formed on both sides of the sleeve body 100 may be applied to protrusions 210 and 220 of the following embodiments which will be described below.

Opposite folding lines 102 may be formed on both sides of the sleeve body 100, as shown in FIGS. 3 to 5.

The folding lines 102 are provided to fold the sleeve body 100 in a flat form so that a space occupied by the respective sleeves 1 is minimized when the sleeves 1 are manufactured and packed with packaging or the sleeves 1 are carried.

If the folding line 102 is formed, as shown in FIG. 4, the sleeve body 100 is folded in such a manner that the front surface and the rear surface are close to each other. In this instance, the front surface and the rear surface of the sleeve body 100 are formed in a flat form, in which the pair of protrusions 210 are formed in the same plane as the sleeve body 100.

Since the pair of protrusions 210 are formed integrally with the sleeve body 100, if the sleeve body 100 is not bent, but folded in a flat form, the pair of protrusions 210 also form the same plane with the sleeve body 100.

In this instance, if the sleeve body 100 is opened wide, as shown in FIG. 5, that is, if a force is applied to both corners of the sleeve body 100 formed with the folding lines 102 to approach each other, the sleeve body 100 is bent to form a curved surface, and the cut line 110 is also bent. In this instance, since the pair of protrusions 210 are not bent unless other external force acts on the protrusions, the protrusions are away from the sidewall of the sleeve body 100 toward the free end. As a result, the protrusions protrude in the outward direction from the sleeve body 100.

Accordingly, the protrusions 210 naturally protrude in the process in which the folded sleeve body 100 is opened wide to form the hollow portion 101. If the cup 10 is retracted from the sleeve 1 and then the sleeve body 100 is again folded, the protrusions 210 are on the same plane as the sleeve body 100.

Since the protrusions 210 can be bent by the external force, the user can grasp the sleeve body together with the protrusions 210, if necessary, in a case in which the protrusions 210 protrude from the sleeve body 100.

The cut line may be formed at any position of the sleeve body 100. The cut line 110 may be formed on the sleeve body 100 formed with the folding line 102, and as shown in FIGS. 3 to 5, be divided into both sides on the basis of the folding line 12.

In this instance, each of the pair of protrusions 210 is positioned on the front and rear surfaces of the sleeve body 100 in a state in which the sleeve body 100 is folded, as shown in FIG. 4. It is preferable that each end portion of the protrusions 210 coincides with an extension line of the folding line 102 so as not to protrude the protrusion 210 from the sleeve body 100 in a lateral direction. It is possible by bringing the longitudinal direction of the cut line 113 formed in the vertical direction and the longitudinal direction of the folding line 102 to coincide with each other.

It is preferable that the folding line 102 is formed on both sides of the sleeve body 100 on the basis of the portion 103 to which both ends of the sleeve body 100 are connected.

Since both ends of the sleeve body 100 are overlapped and connected, the thickness of the connected portion 103 is twice as much as the other portion of the sleeve body 100. Accordingly, the connected portion 103 is less bent than other portion.

Therefore, if the folding line 102 is roughly equidistant from the connected portion 103, the hollow portion 101 is not biased when the sleeve body 100 is opened wide.

In addition, in the pair of protrusions 210, one protrusion (referred to as a first protrusion) which is farther far from the connected portion 103 may be formed in long length relative to another protrusion (referred to as a second protrusion) which is closer to the connected portion.

This is considered that the connected portion 103 is less bent. Since the sleeve body farther far from the connected portion 103 is relatively less bent than the sleeve body closer to the connected portion, the first protrusion which is farther far from the connected portion 103 may protrude from the sidewall of the sleeve body 100 in a narrow interval in comparison to the second protrusion) which is closer to the connected portion. Accordingly, the first protrusion 211 is formed more long than a length of the second protrusion 212 so as to generally match the protruding amount of the first and second protrusions 211 and 212.

Although not shown, the folding line 102 may be provided with a plurality of cut lines (now shown) spaced apart from each other at a predetermined interval along a longitudinal direction of the folding line 102. The front and rear surfaces of the sleeve body 100 are completely in contact with each other in FIG. 4 by the cut lines, thereby easily folding the sleeve body.

FIG. 6 shows the use state of the first embodiment. Since the protrusions 210 are caught by upper portions of the fingers, as shown in the figure, the user can gently grip the sleeve 1 without slippage, thereby reliably gripping the sleeve 1 in spite of the heat transmitted from the cup 10.

Figure 7:
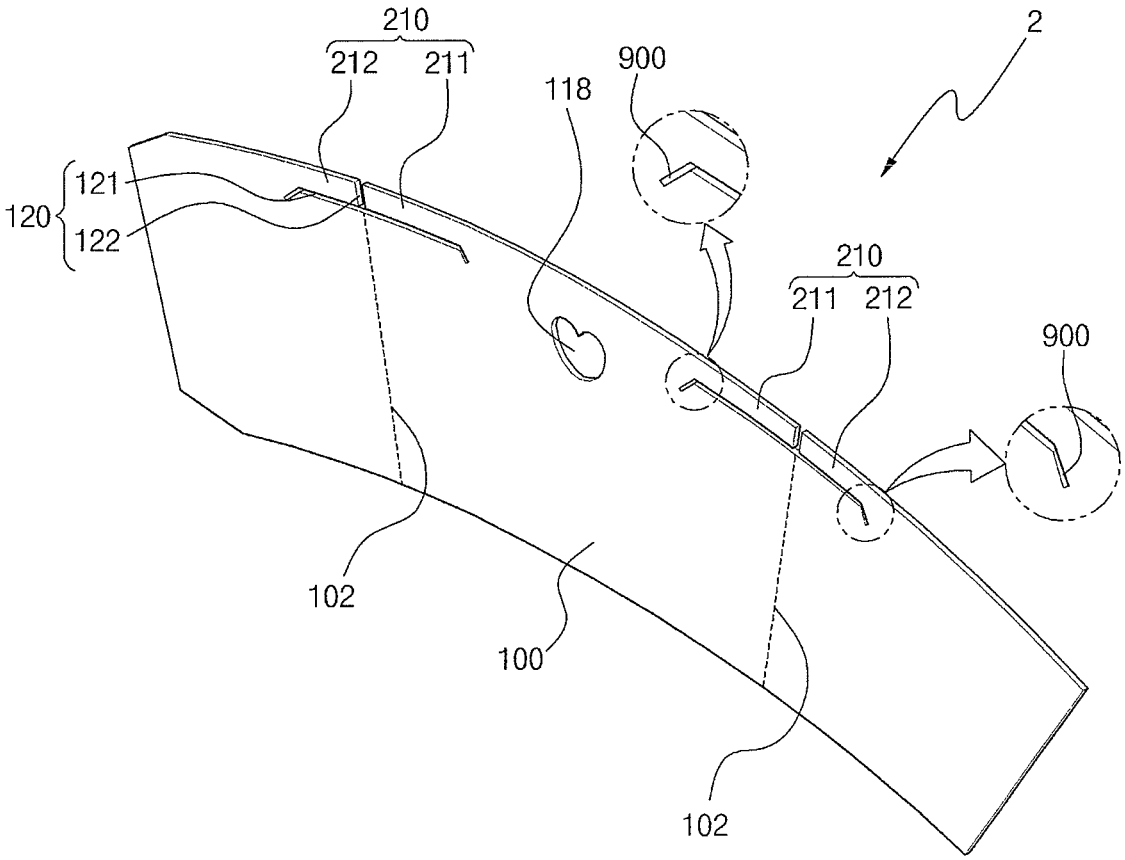
FIG. 7 is a deployment view of a sleeve according to a second embodiment of the present invention.
Figure 8:
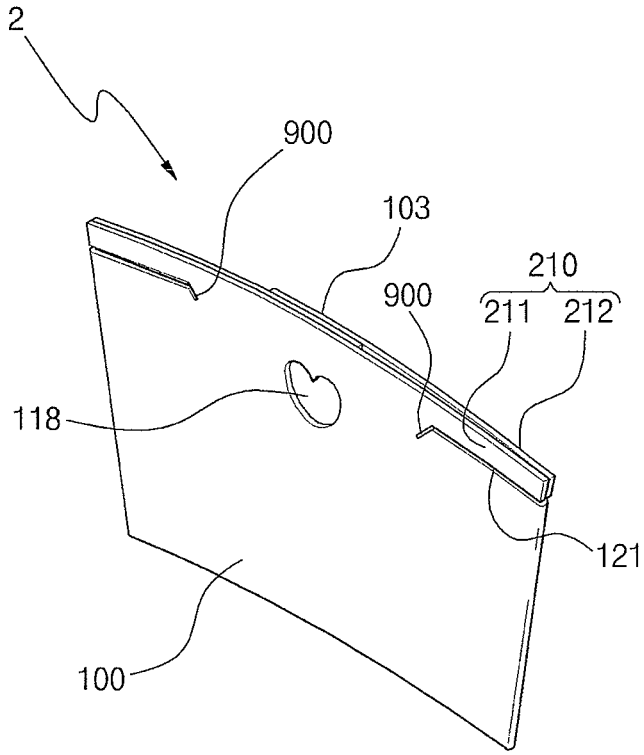
FIG. 8 is a perspective view illustrating a state in which the sleeve body in FIG. 7 is folded.
Figure 9:
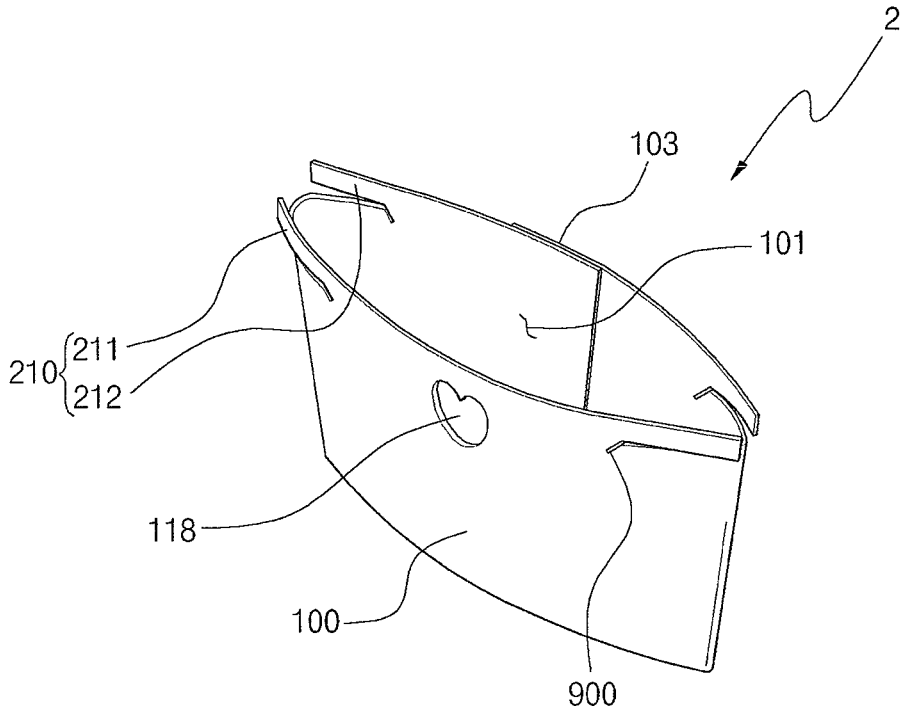
FIG. 9 is a perspective view illustrating a state in which protrusions protrude as the sleeve body in FIG. 7 is opened wide.

FIGS. 7 to 9 show an insulating sleeve 2 for a cup according to a second embodiment of the present invention. FIG. 7 is a deployment view of the sleeve according to the second embodiment of the present invention. FIG. 8 is a perspective view illustrating a state in which the sleeve body in FIG. 7 is folded. FIG. 9 is a perspective view illustrating a state in which protrusions protrude as the sleeve body in FIG. 7 is opened wide;

In this embodiment, the cut line 120 is formed on an upper sidewall of the sleeve body 100.

In this embodiment, a cut line is formed in a horizontal direction on a position spaced apart from the uppermost end of the sleeve body 100 at a predetermined distance, and a cut line 122 is formed in a vertical direction on the sleeve body 100 positioned over the cut line 121, thereby the ⊥-shaped cut line 120. A pair of protrusions 210 are divided into two parts by the cut lines 122 of the vertical direction.

In this embodiment, the extension cut line 900 of the first embodiment may be formed in a downward inclined manner on the end portion of the cut line 120, that is, the end portion of the cut line 121 of the horizontal direction. In this embodiment, the extension cut line 900 is to enhance the protruding property of the protrusion 210 and to bring the sleeve body in contact with the cup.

Further, as shown in the figure, a cut portion 118 is formed on the outer wall of the insulation sleeve body 100 to represent the symbol or character printed on the cup.

Figure 10:
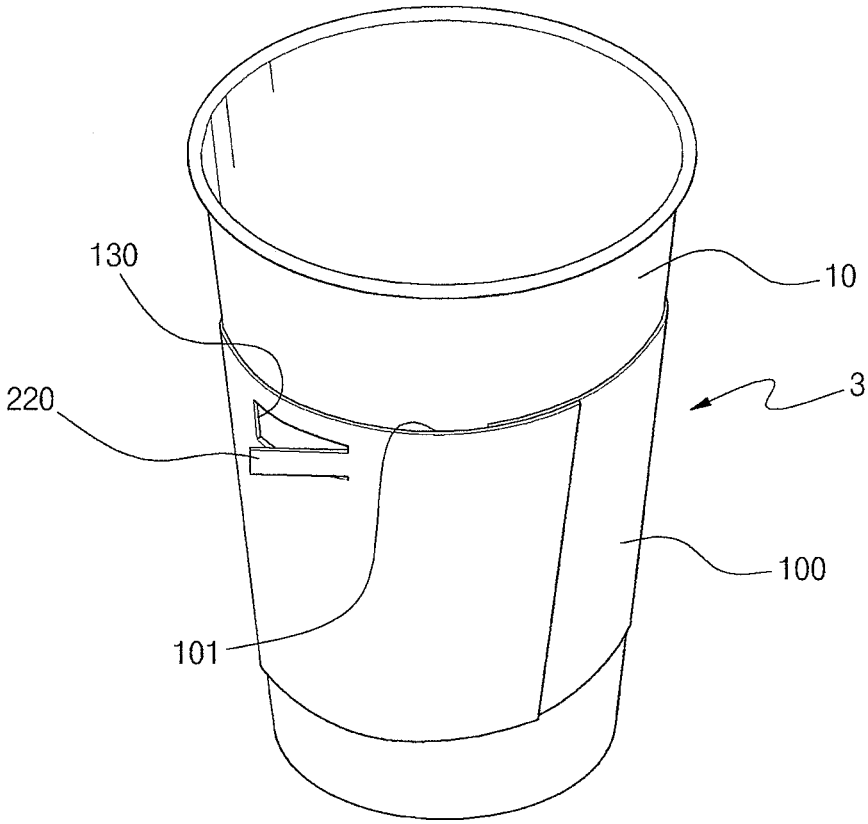
FIG. 10 is a perspective view illustrating a state in which a cup is accommodated in an insulation sleeve according to a third embodiment of the present invention.
Figure 11:
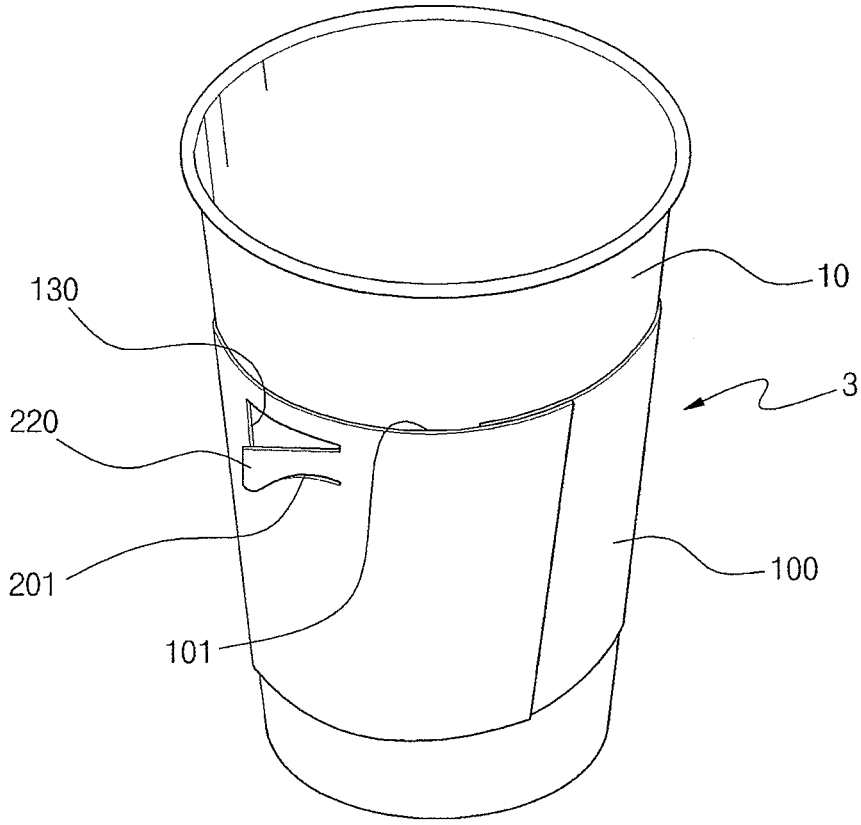
FIG. 11 is a perspective view illustrating another example of the protrusion in FIG. 10.
Figure 12:
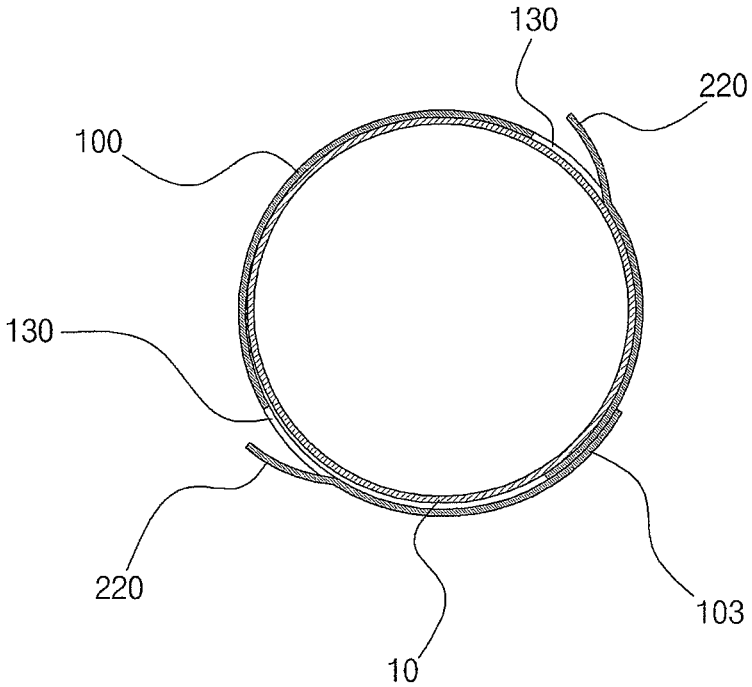
FIGS. 12 to 14 are cross-sectional views illustrating various protruding directions of the protrusions in FIG. 10.
Figure 13:
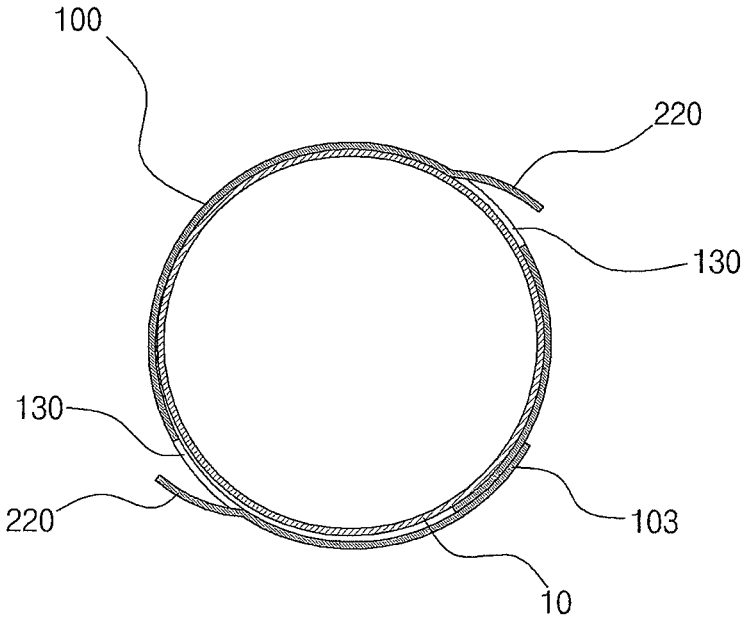
Figure 14:
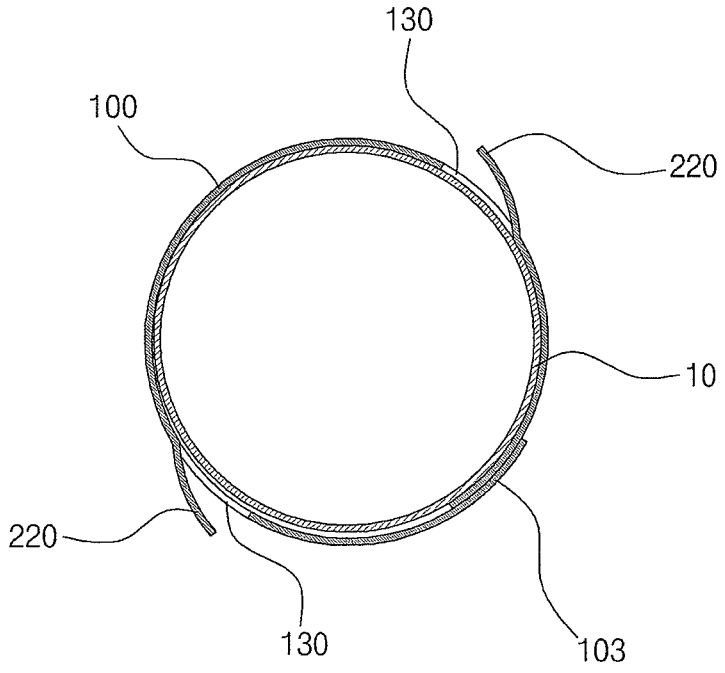
Figure 15:
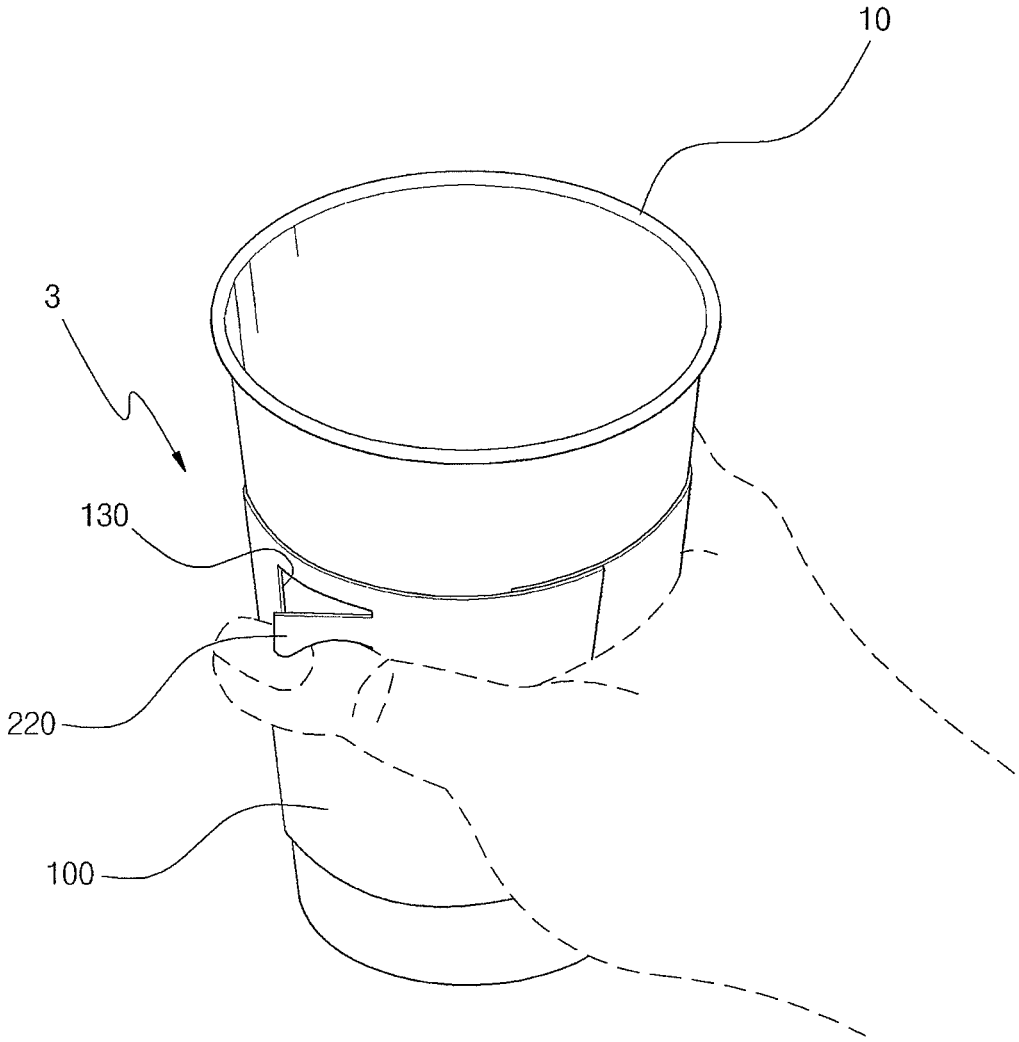
FIG. 15 is a view illustrating a use state of the sleeve in FIG. 10.

FIGS. 10 to 15 show an insulating sleeve for a cup according to a third embodiment of the present invention. FIG. 10 is a perspective view illustrating a state in which a cup is accommodated in an insulation sleeve according to the third embodiment of the present invention. FIG. 11 is a perspective view illustrating another example of the protrusion in FIG. 10. FIGS. 12 to 14 are cross-sectional views illustrating various protruding directions of the protrusions in FIG. 10. FIG. 15 is a view illustrating a use state of the sleeve in FIG. 10.

A cut line 130 is formed on a sleeve body 100 of an insulation sleeve 3, and thus protrusions 220 protrude from the sleeve body 100 in an outward direction.

As shown in FIG. 10, the cut line 130 is formed in a ⊂-shape, and may be formed in a reverse direction. Alternatively, although not shown, the cut line may be formed in a ⊃-shape, and may be formed in a forward direction.

Since the sidewall of the sleeve body 100 is provided with the ⊂-shaped cut line 130 in a forward direction or a reverse direction, a protrusion 220 of a substantially rectangular shape is formed on the inside of the cut portion.

One end portion of the protrusion 220 is formed integrally with the sleeve body 100, and the other end portion of the protrusion 220 is extended in a horizontal direction to form a free end.

Accordingly, in the state in which the sleeve body 100 is folded, the protrusions 220 are laid on the substantially same plane as the sleeve body 100. When the sleeve body 100 is opened wide so as to accommodate the cup in the sleeve body 100, that is, form a hollow portion 101, the other end portion of the protrusion 220 protrudes from the sleeve body 100 in the outward direction, with the other end portion being away from the sidewall of the sleeve body 100.

Since the protrusions 220 protruding in the outward direction are caught by upper portions of the fingers, the user can gently grip the sleeve body 100, thereby reliably gripping the sleeve body 100 without slippage of the sleeve body.

It is preferable that considering that the sleeve body 100 is gripped, the cut line 130 and the protrusions 220 are formed at the upper portion of the sleeve body 100. FIG. 10 shows an example in which the cut line 130 and the protrusions 220 are formed at a position spaced apart from the uppermost end of the sleeve body 100 at a predetermined distance.

FIG. 11 shows another example of the protrusion 220 shown in FIG. 10. As shown in the figure, a lower portion of the protrusion 220 may be provided with a curved portion 201 corresponding to the shape of an upper surface of a finger catching the protrusion 220.

Since the curved portion 201 of the protrusion comes in contact with the upper surface of the finger in a wrapping manner, the hand can grip the sleeve body 100 more reliably. The curved portion 201 may be applied to the protrusion 210 shown and described in the first and second embodiments and the protrusion 220 of other embodiments which will be described below.

In this instance, the protrusions 220 may be formed on both sides of the sleeve body 100, as described in the first and second embodiments. In this instance, the extending direction of the protrusion 220 from the sleeve body 100 may be selected in various sizes by taking a size of the user's hand or a cup holding habit into consideration. Further, the protrusions 220 may be installed at different position by taking a length of the user's finger into consideration.

More specifically, FIG. 12 shows an example in which any one of the protrusions 220 is formed in a clockwise direction, and the other is formed in counterclockwise direction.

FIG. 13 shows an example in which both protrusions 220 are formed in a clockwise direction, and FIG. 14 shows an example in which both protrusions are formed in a counterclockwise direction.

FIG. 15 shows an example of a use state of the insulation sleeve 3 according to this embodiment.

As shown in the figure, the protrusions 220 are caught by the hand gripping the sleeve body 100 to prevent the slippage, so that the user can easily grip the sleeve body 100. In the example in which the curved portion 201 is formed, the curved portion comes in contact with the upper surface of the finger in a wrapping manner, so that the hand can grip the sleeve body 100 more reliably.

Figure 16:
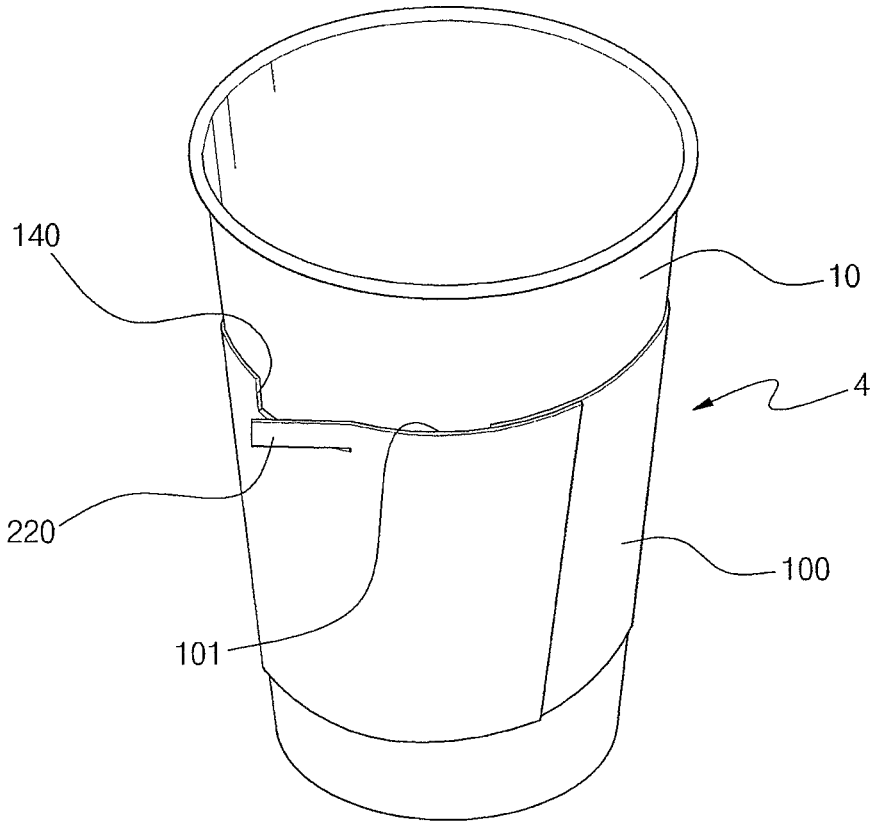
FIG. 16 is a perspective view illustrating a state in which a cup is accommodated in an insulation sleeve according to a fourth embodiment of the present invention.
Figure 17:
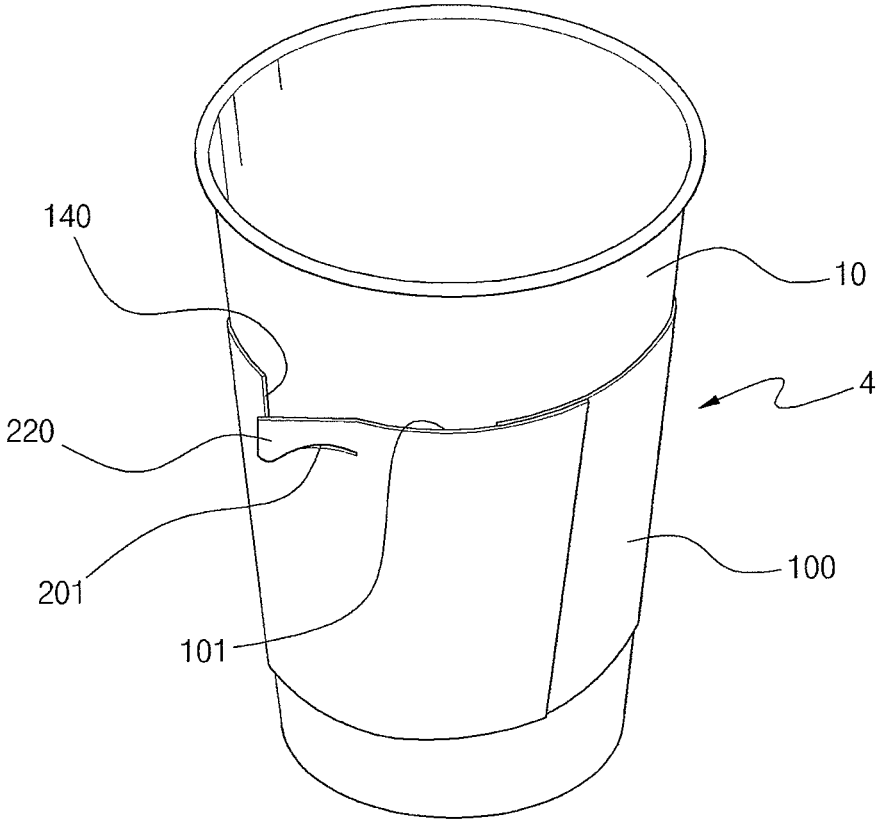
FIG. 17 is a perspective view illustrating another example of the protrusions in FIG. 16.
Figure 18:
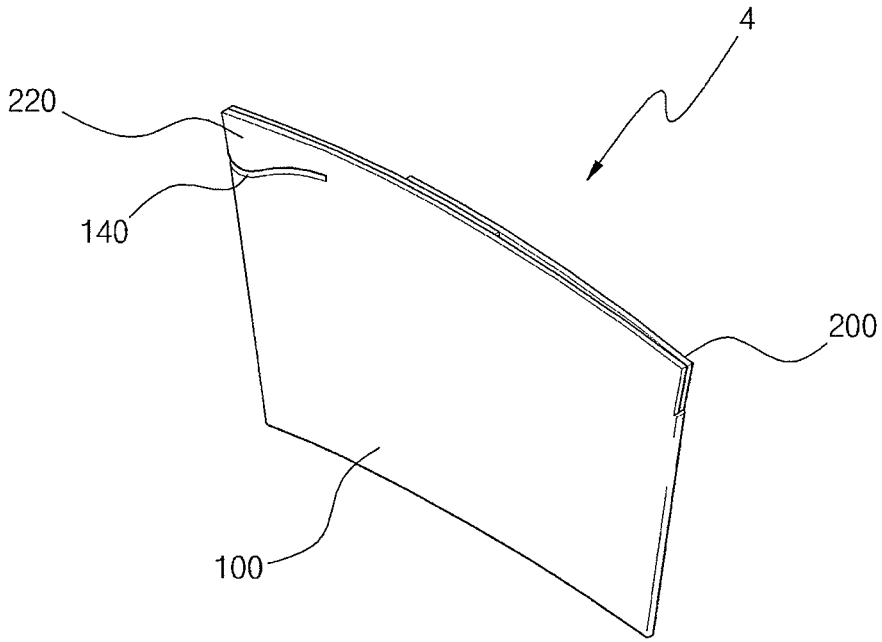
FIG. 18 is a perspective view illustrating a state in which the sleeve body in FIG. 16 is folded.

FIGS. 16 and 18 show an insulation sleeve according to a fourth embodiment of the present invention. FIG. 16 is a perspective view illustrating a state in which a cup is accommodated in the insulation sleeve according to the fourth embodiment of the present invention. FIG. 17 is a perspective view illustrating another example of the protrusions in FIG. 16. FIG. 18 is a perspective view illustrating a state in which the sleeve body in FIG. 16 is folded.

According to the insulation sleeve 4 of this embodiment, a cut line 140 is formed on the upper end of a sidewall of the sleeve body 100.

More specifically, as shown in FIG. 16, the cut line 140 is formed in a forward L-shape on the upper end of the sidewall of the sleeve body 100, and may be formed in a reverse L-shape which is not shown.

Since the sidewall of the sleeve body 100 is provided with the cut line 140, a protrusion 220 of a substantially rectangular shape is formed on the inside of the cut portion, similar to the first embodiment.

FIG. 17 shows an example in which the lower portion of the protrusion 220 shown in FIG. 16 is provided with a curved portion 201.

As shown in FIG. 18, it is preferable that the end of the protrusion 220 does not protrude in a lateral direction of the sleeve body 100 in a state in which the sleeve body 100 is folded along the fold line 102. This is similar to the case of the third embodiment.

Figure 19:
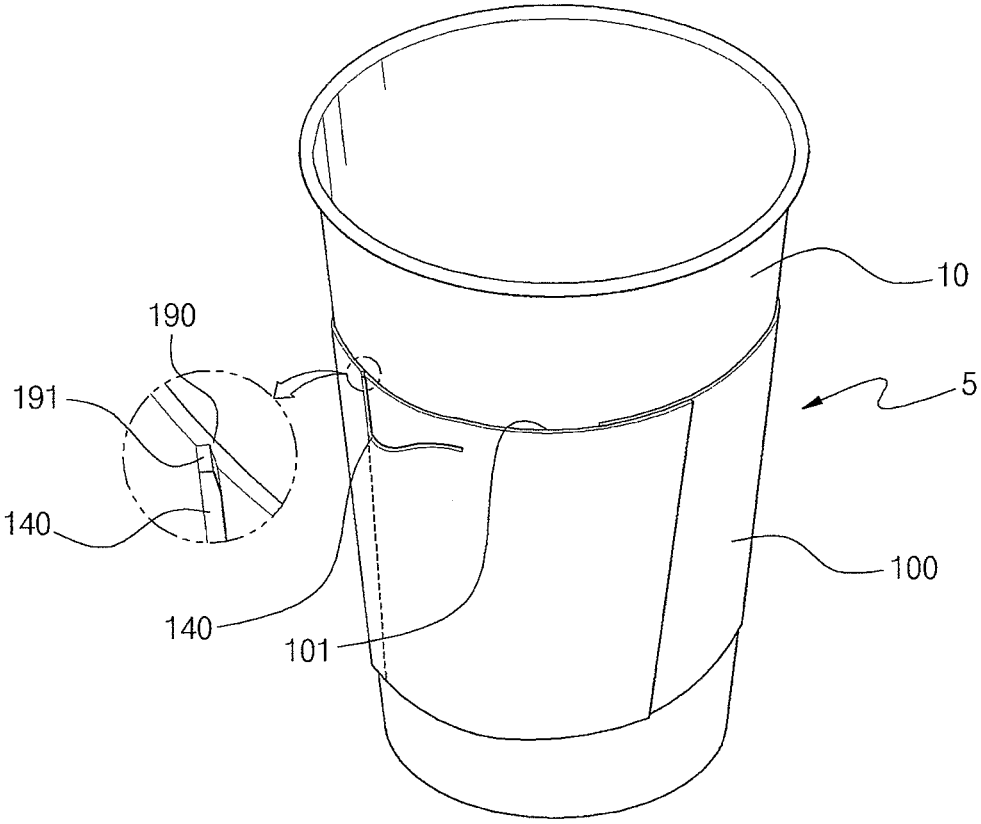
FIG. 19 is a perspective view illustrating a sleeve according to a fifth embodiment of the present invention.
Figure 20:
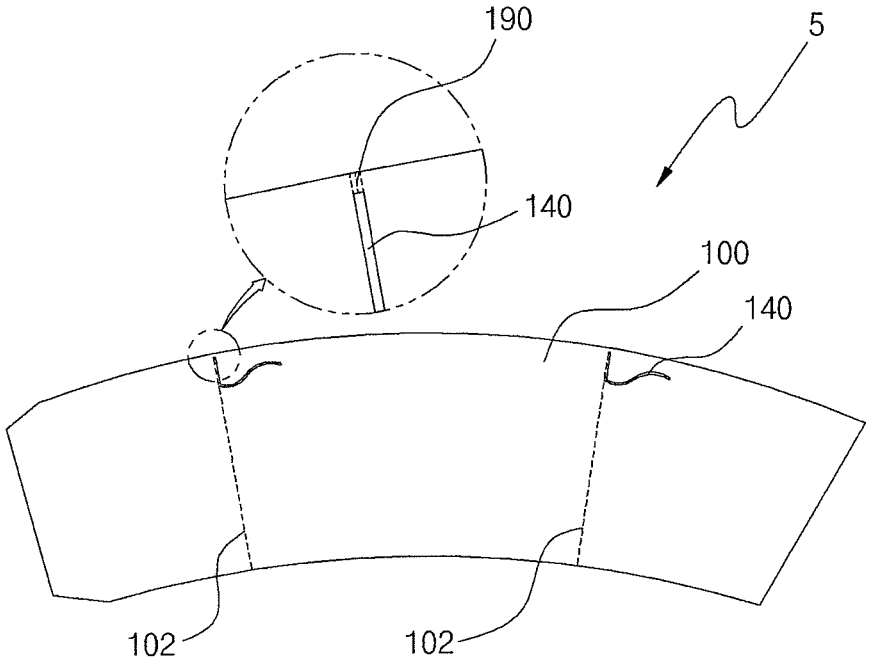
FIG. 20 is a deployment view of the sleeve in FIG. 19.

FIGS. 19 and 20 show an insulation sleeve according to a fifth embodiment of the present invention. FIG. 19 is a perspective view illustrating the sleeve according to the fifth embodiment of the present invention. FIG. 20 is a deployment view of the sleeve in FIG. 19.

The insulation sleeve is packaged or carried in a state in which the front and rear surfaces of the sleeve body 100 are closely folded, before the insulation sleeve holds the cup 10, that is, the insulation sleeve is used by a user at a take-out shop.

In this instance, since the protrusion 220 does not protrude from the sleeve body 100, but is flush with the sleeve body 100, even though a plurality of insulation sleeves are stacked and packaged, there is no problem in the packaging process or carrying process in comparison with a conventional sleeve with no protrusion 220.

The protrusion 220 may be deformed or damaged due to friction or collision with neighboring objects in the packaging or carrying process of the insulation sleeve 1, in a keeping process before it is used in a shop such as take-out shop.

Accordingly, this embodiment provides a means for protecting the protrusion 220 from being damaged.

In this embodiment, a joint portion 190 is formed on the cut line 140 in the case of the insulation sleeve 4 of the fourth embodiment.

In this embodiment, the cut line 140 is not cut, and the joint portion 190 is formed on the cut line 140 integrally with the sleeve body 100. The protrusion 220 does not protrude from the sleeve body 100 by the joint portion 190, and is flush with the sleeve body 100.

Consequently, the movement of the protrusion 220 is prevented by the joint portion 190, so that the protrusion 220 is not damaged even though it fractionizes or collides with other object when packaging, carrying or keeping.

When the joint portion 190 is cut, the complete cut line 140 is formed, and thus the protrusion 220 protrudes from the sleeve body 100 in an outward direction. It is preferable that the joint portion 190 is easily cut by an external force. Accordingly, the joint portion 191 may be provided with a groove 191 on outer and inner surfaces (in the figure, the groove is formed on the outer surface) so as to minimize the vertical width or the thickness of the joint portion 190.

In this instance, the external force may be an artificial force of the user. That is, in a state in which the sleeve body 100 is opened wide so as to accommodate the cup 10 in the sleeve body 100, that is, the sleeve body 100 is opened wide so as to provide the hollow portion 101, the user cuts the joint portion 190, so that the protruding of the protrusion 220 can be guided.

In the process of accommodating the cup 10 in the sleeve body 100, the joint portion 190 can be naturally cut. In this instance, the sleeve body 100 is moved from the lower side to the upward side by an indirect external force applied from the user so as to accommodate the cup 10 in the sleeve body 100. When the sleeve body 100 is moved upward along the sidewall of the cup 10 to hold the cup 10, the upper end of the sleeve body 100 reaching the sidewall of the cup 10 at a predetermined position is further widened by a direction external force which is generated by a diameter difference between the sidewall of the cut 10 at the predetermined position and the inner periphery of the sleeve body 100 at the upper end thereof.

One or more joint portion 190 may be provided, and in this embodiment, one joint portion is formed. A preferred position, at which the joint portion 190 is formed, is on the cut line 140 which is the end of the protrusion 220 in the horizontal direction and the uppermost portion thereof. Although not shown, at least two joint portions 190 may be formed on the cut line 110 in a spaced manner.

Figure 21:
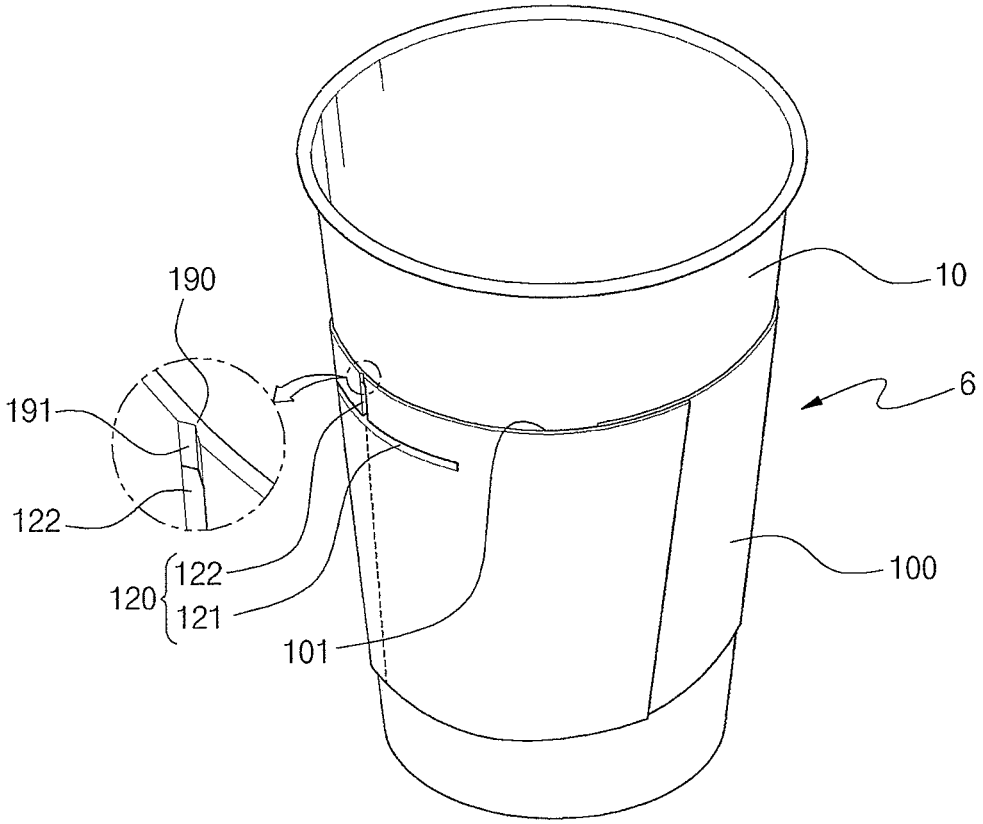
FIG. 21 is a perspective view illustrating a state in which a cup is accommodated in a sleeve according to a sixth embodiment of the present invention.
Figure 22:
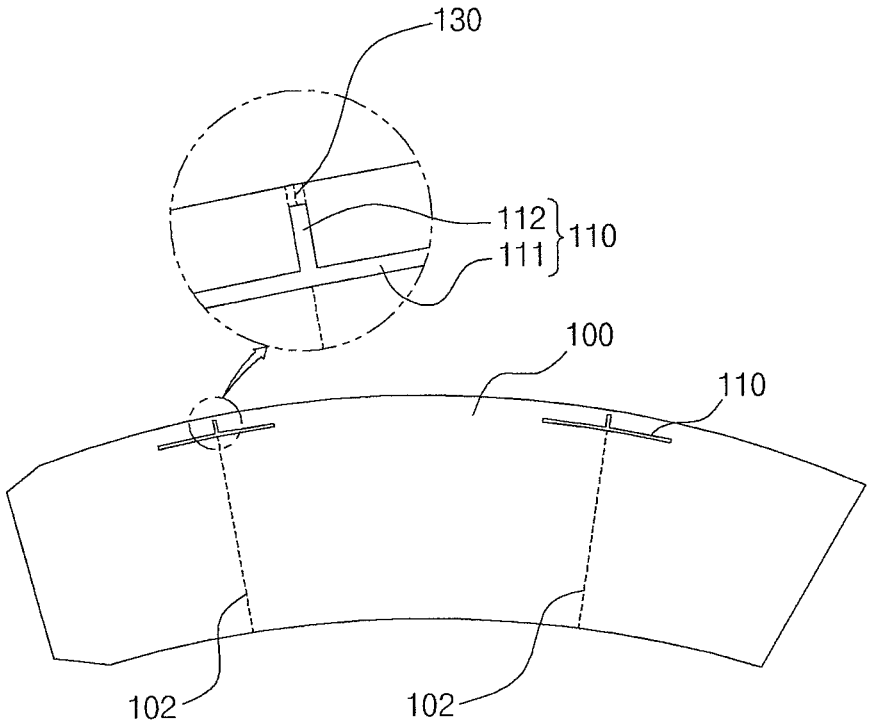
FIG. 22 is a deployment view of the sleeve in FIG. 21.

FIGS. 21 and 22 show the insulation sleeve for a cup according to a sixth embodiment of the present invention. FIG. 21 is a perspective view illustrating a state in which the cup is accommodated in the sleeve according to the sixth embodiment of the present invention. FIG. 22 is a deployment view of the sleeve in FIG. 21.

In this embodiment, an insulation sleeve 6 with the joint portion 190 formed on the cut line 120 is provided, as an alternative example of the insulation sleeve 2 according to the second embodiment.

The cut line 120 of this embodiment consists of a horizontal cut line 121 and a vertical cut line 122 to form a ⊥ shape, as described in the second embodiment. The joint portion 190 is formed on the cut line 120, and the joint portion 190, and the joint portion 190 is cut to form the complete cut line 120.

In this embodiment, one joint portion 190 is formed on the vertical cut line 122 so as to easy cut the joint portion 190. The present invention is not limited thereto, and two or more joint portion 190 may be formed on the cut line 120, similarly to the fifth embodiment.

The joint portion 190 described and shown in FIGS. 5 and 6 may not only be formed on the cut lies 120 and 140 of the second and fourth embodiments, but also be formed on the cut lines 110 and 130 of the first and third embodiments.

Figure 23:
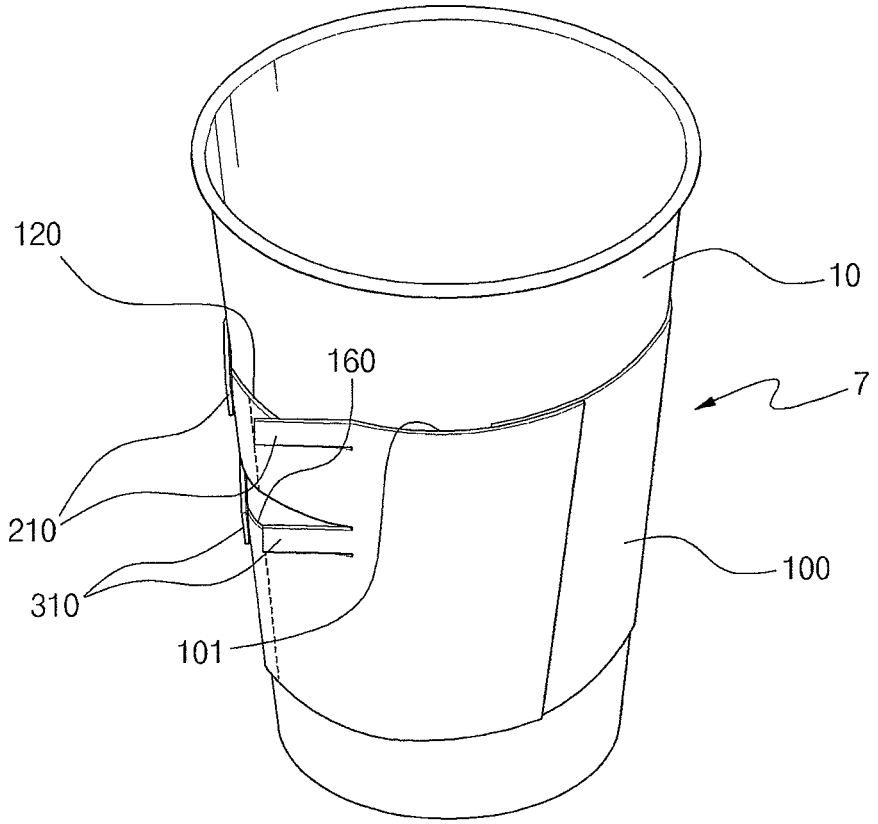
FIG. 23 is a perspective view illustrating a state in which a cup is accommodated in a sleeve according to a seventh embodiment of the present invention.
Figure 24:
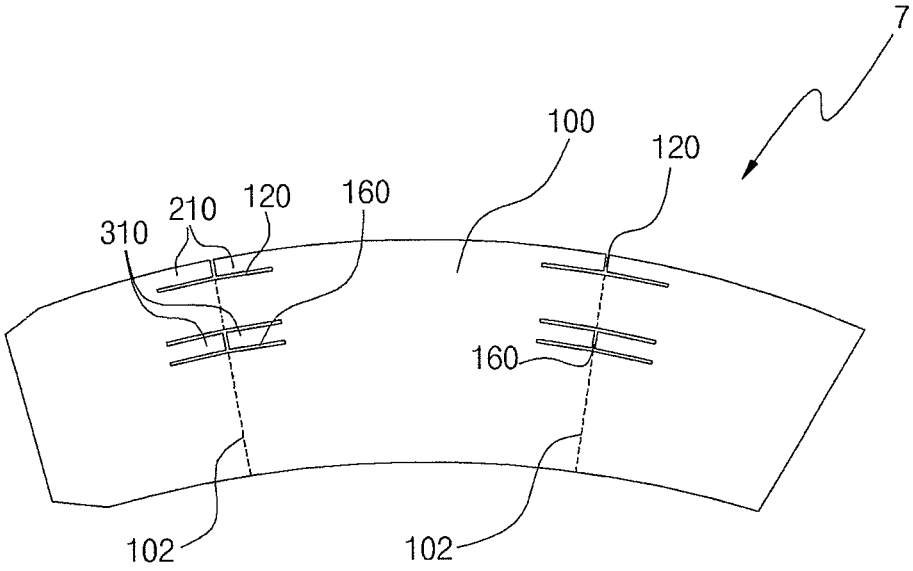
FIG. 24 is a deployment view of the sleeve in FIG. 23.

FIGS. 23 and 24 show the insulation sleeve for a cup according to a seventh embodiment of the present invention. FIG. 23 is a perspective view illustrating a state in which the cup is accommodated in the sleeve according to the seventh embodiment of the present invention. FIG. 24 is a deployment view of the sleeve in FIG. 23.

The insulation sleeve 7 of this embodiment is provided with a protrusion 210 similar to the protrusion 210 of the second embodiment, and a support portion 310 protruding from the lower portion of the protrusion 210.

In recent years, low-volume cups, such as 6 ounces, generally used in a take-out coffee shop can be sufficiently applied to the heat sleeves 1, 2, 3, 4, 5, and 6 shown in Embodiments 1 to 6. For high-volume cups, such as 13 ounces or more, however, the insulation sleeves of the first to sixth embodiments is not stable due to the weight of the cup including the content carried therein or the size of the cup itself.

If the sleeve body is provided with a support portion 310 so as to position a finger between the support portion and the protrusion 210, the upper portion of the finger comes in contact with the protrusion 210 formed at the upper portion, the lower portion of the finger comes in contact with the support portion 310 formed at the lower portion, thereby reliably holding the sleeve body with the fingers. In the case of the high-volume cup of 13 ounces or more, since the upper and lower portions of the finger are supported, the user can reliably grip the cup when moving with the cup.

In this embodiment, it can be effectively applied to the cup of 13 ounces or more.

The support portion 310 will now be described in detail.

In this embodiment, the protrusion 210 similar to the protrusion 210 of the second embodiment is formed, and the sleeve body is further provided with the support portion 310 at a position below the protrusion 210. The support portion 310 is spaced apart from the protrusion 210 by a width of a finger and protrudes from the sleeve body 100 in an outward direction.

In this instance, since the ⊥-shaped cut line 160 is formed on the sleeve body 100 below the cut line 120 and is spaced apart from the cut line 120 by at least the width of a finger, the opposite support portions 310 are provided in pair. Similar to the protrusion 210, when the sleeve body 100 is opened wide so as to form the hollow portion 101, the support portions protrude from the sleeve body in an outward direction.

The support portion 310 has preferably a width so as not to cause friction in the process of protruding the support portions 310. Similar to the protrusion 210, the support portion 310 may be provided on both sides of the sleeve body 100. Further, a joint portion 190 may be formed on the cut line 160 forming the support portion 310. The feature of the support portion 310 may be applied to the support portion 320 according to the eighth embodiment which will be described below.

The above-described support portion 310 may be provided on the sleeve body 100 of the first embodiment, as well as the second embodiment.

Figure 25:
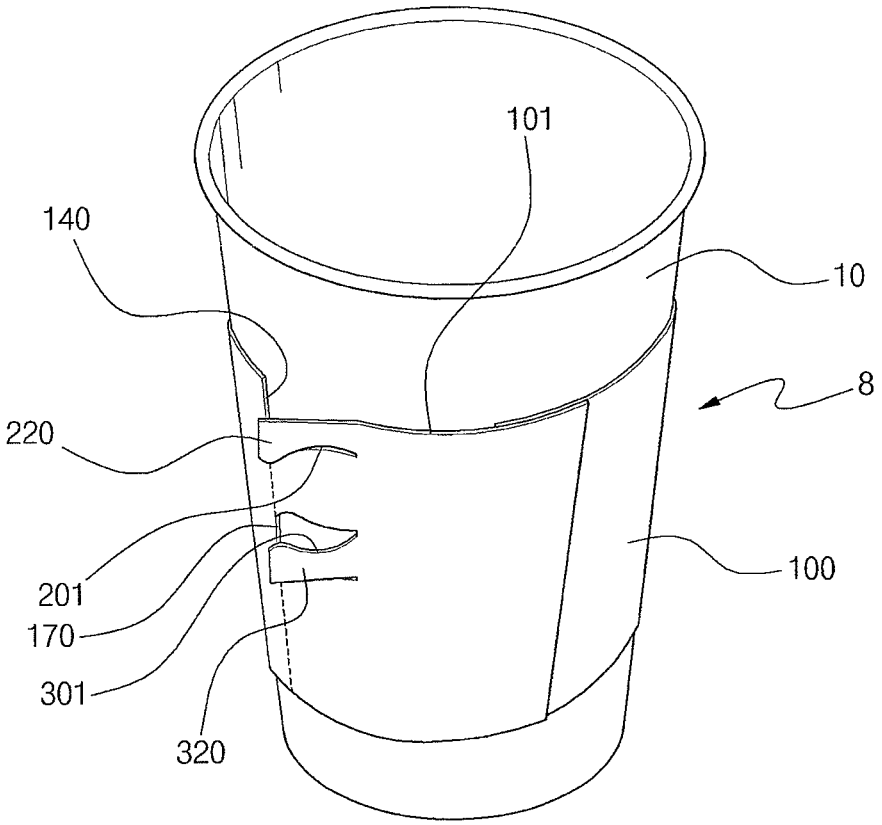
FIG. 25 is a perspective view illustrating a state in which a cup is accommodated in a sleeve according to an eighth embodiment of the present invention.
Figure 26:
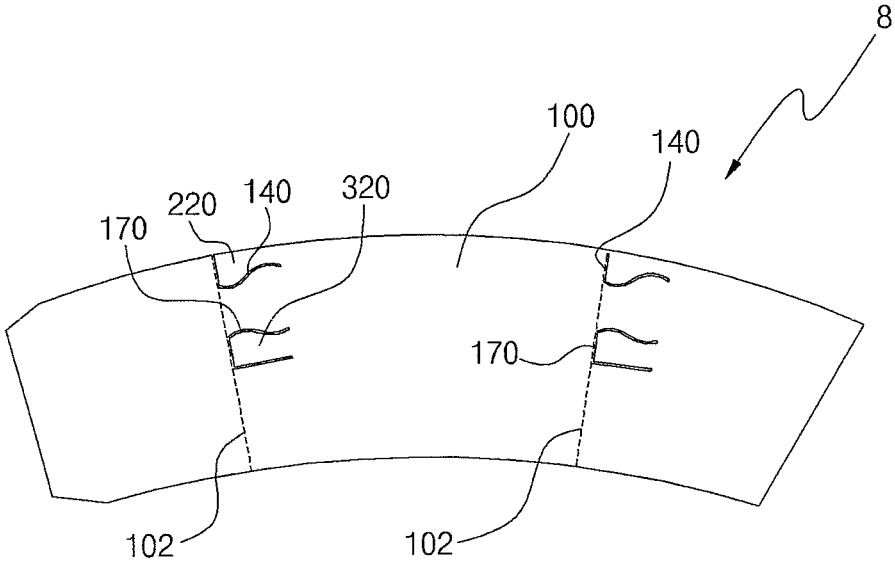
FIG. 26 is a deployment view of the sleeve in FIG. 25.
Figure 27:
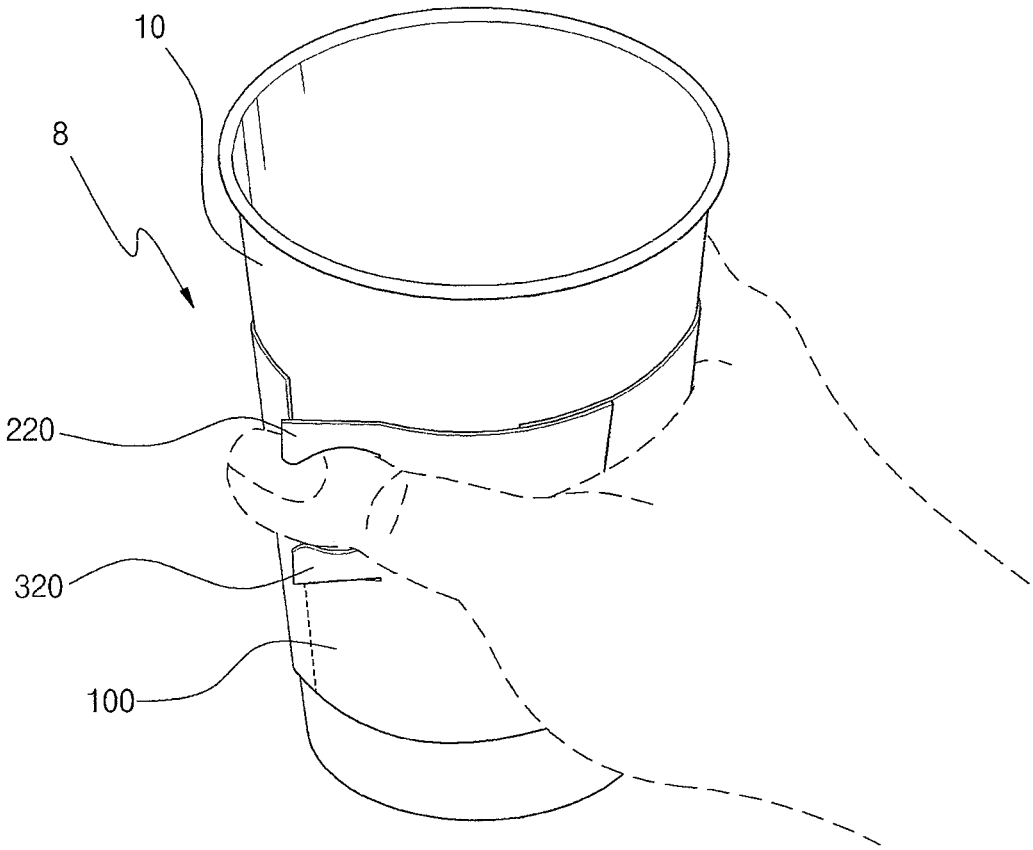
FIG. 27 is a view illustrating a use state of the sleeve in FIG. 25.

FIGS. 25 to 27 show an insulation sleeve according to an eighth embodiment of the present invention. FIG. 25 is a perspective view illustrating a state in which the cup is accommodated in the sleeve according to the eighth embodiment of the present invention. FIG. 26 is a deployment view of the sleeve in FIG. 25. FIG. 27 is a view illustrating a use state of the sleeve in FIG. 25.

The insulation sleeve 8 of this embodiment is provided with a support portion 320 having the same function as the above-described support portion 310.

The support portion 320 of this embodiment is provided with a ⊂-shaped cut line 170 at a portion of the sleeve body 100 which is spaced apart from the cut line 140 by at least the width of a finger. Therefore, similar to the protrusion 220, when the sleeve body 100 is opened wide so as to form the hollow portion 101, the support portions protrude from the sleeve body in an outward direction.

The ⊂-shaped cut line 170 is formed in a forward direction, as shown in FIG. 25, and may be formed in a reverse direction.

An upper portion of the support portion 320 may be provided with a curved portion 301 corresponding to the shape of a lower surface of a finger. The curved portion 301 may be formed on the support portion 310 according to the seventh embodiment.

As shown in FIG. 27, the user can reliably grip the sleeve body 100, with the finger being positioned between the protrusion 220 and the support portion 320.

The support portion 320 may be formed on the sleeve body 100 of the third embodiment, as well as the sleeve body of the fourth embodiment.

In addition, in order to further protrude the protrusions 210 and 220 and the support portions 310 and 320, the end portion of the cut lines may be provided with inclined extension cut line 900 of about 0.5 mm to about 3 mm, and the inclined angle is about 20 degrees to about 50 degrees.

Although it is described on the basis of the case in which the content filled in the cup 10 is hot, the present invention is not limited thereto. The present invention may be applied to a cold drink. In addition to the corrugated cardboard, paper having a predetermined thickness can be applied to the sleeve body.

With the above description, since the sleeve body is provided with the protrusions protruding from the sidewall thereof, the protrusions are caught by the fingers of the hand gripping the sleeve body to prevent the slippage.

Further, since the protrusions naturally protrude from the sleeve body in the outward direction in the process of opening the folded sleeve body, it is not necessary for separate manipulation to bring the protrusion to protrude.

Since the protrusions formed integrally with the sleeve body can be resiliently bent in view of its material property, the user can grip the sleeve body with the protrusions.

Further, since the cut line is formed by a simple cutting manner, a manufacturing cost or manufacturing process is not complicated, as compared with a conventional sleeve.

Since the protrusions do not protrude from the sleeve body in the outward direction in a stat in which the sleeve body is folded, the packaging convenience or packaging volume is not different from the conventional sleeve, even though the cut line is formed.

In addition, the protrusions protruding from the sidewall of the sleeve body occupies an area which is required for the finger gripping the upper portion of the sleeve body, so that it does not obstruct the formation of the printed surface for advertisement on the sidewall of the sleeve body.

Further, since the user can smoothly grip the cup by the protrusions, the gripping is easy and the movement of the held cup is safe. Also, the heat conduction to the hand is minimized.

In the case in which the uncut joint portion is formed on the cut line, it is possible to prevent the protrusions from being moved at the packaging, carrying, or keeping and thus prevent the deformation or damage of the protrusions.

Further, in the case in which the support portion is provided, in addition to the protrusion, the fingers gripping the sleeve body are supported at upper and lower sides, it is possible to reliably hold the cup.

In addition, since the characters or symbols printed on the outer wall of the cup sleeve are represented at a predetermined temperature, it is possible to allow the consumer to predict the temperature of the coffee when he or she grips the sleeve holding the cup, thereby preventing the consumer from scalding.

Although preferred embodiments of the present invention have been described for illustrative purposes, those skilled in the art will appreciate that various modifications, additions and substitutions are possible, without departing from the scope and spirit of the invention as disclosed in the accompanying claims.

What is claimed is:

1. An insulation sleeve for a cup comprising:

a sleeve body adapted to be folded to comprise a folded sleeve body having corners at a first end and second end; said sleeve body having a hollow portion which is formed when a force is applied to said first and second end corners of the folded sleeve body so as to accommodate and support the cup therein; and a pair of protrusions provided by an H-shaped cut line formed on the sleeve body, where the H-shaped cut line is rotated at a right angle and protruding from the sleeve body in an outward direction when the hollow portion is provided, wherein the protrusions are positioned by an upper portion of a finger of a hand gripping the sleeve body.

2. The insulation sleeve according to claim 1, further comprising a I-shaped cut line formed on a portion of the sleeve body which is spaced apart from the cut line in a downward direction by at least a width of the finger, in which a support portion protrudes from the sleeve body in an outward direction when the hollow portion is provided.

3. The insulation sleeve according to any one of claim 1, wherein the cut line has a minimum width so as not to cause friction when the protrusion protrudes.

4. The insulation sleeve according to claim 2, wherein the cut line has a minimum width so as not to cause friction when the protrusion protrudes.

5. The insulation sleeve according claim 1, wherein a lower portion of the protrusion is provided with a curved portion corresponding to a shape of an upper surface of the finger so that the protrusion comes close in contact with the finger.

6. The insulation sleeve according to claim 1, wherein an end of the cut line is provided with an extension cut line.

7. The insulation sleeve according to claim 1, further comprising another pair of protrusions produced by an H shaped cut line where the H is rotated at right angle formed on an upper portion of the sleeve body in an opposing side of said pair of protrusions.

* * * * *